US007172107B2

(12) United States Patent
Kranz

(10) Patent No.: US 7,172,107 B2
(45) Date of Patent: Feb. 6, 2007

(54) ENVELOPE HAVING IMPROVED OVERLAP PROFILE

(75) Inventor: Richard Kranz, Leawood, KS (US)

(73) Assignee: Tension Envelope Corporation, Kansas City, MO (US)

( * ) Notice: Subject to any disclaimer, the term of this patent is extended or adjusted under 35 U.S.C. 154(b) by 7 days.

(21) Appl. No.: 10/418,802

(22) Filed: Apr. 18, 2003

(65) Prior Publication Data

US 2005/0230458 A1 Oct. 20, 2005

Related U.S. Application Data

(63) Continuation-in-part of application No. 09/969,944, filed on Oct. 3, 2001, now abandoned.

(51) Int. Cl.
*B65D 27/00* (2006.01)

(52) U.S. Cl. ..... 229/68.1; 229/75

(58) Field of Classification Search ..... 229/75, 229/68.1, 307, 315–316
See application file for complete search history.

(56) References Cited

U.S. PATENT DOCUMENTS

| | | | | |
|---|---|---|---|---|
| 442,841 | A | 12/1890 | West | |
| 1,171,323 | A * | 2/1916 | D'Agostino | 229/75 |
| 1,796,723 | A * | 3/1931 | Rife | 493/362 |
| 1,943,688 | A * | 1/1934 | Moore | 229/75 |
| 2,001,340 | A | 5/1935 | Bear | |
| 2,014,914 | A | 9/1935 | Teicher | |
| 2,074,949 | A | 3/1937 | Swift | |
| 2,128,196 | A | 8/1938 | Vogel | |
| 2,384,223 | A | 9/1945 | Wilbur | |
| 3,338,500 | A * | 8/1967 | Bushey | 206/0.815 |
| 3,370,781 | A | 2/1968 | Sroge | |
| 3,420,432 | A * | 1/1969 | Cooper | 229/71 |
| 3,467,299 | A | 9/1969 | Meyer | |
| 3,558,040 | A | 1/1971 | Krueger | |
| 3,946,938 | A | 3/1976 | Kranz | |
| 4,047,661 | A | 9/1977 | Klein | |
| 4,072,264 | A | 2/1978 | Kranz | |
| 4,180,168 | A | 12/1979 | Hiersteiner | |

(Continued)

FOREIGN PATENT DOCUMENTS

DE 3027484 A1 7/1980

(Continued)

*Primary Examiner*—Jes F. Pascua
(74) *Attorney, Agent, or Firm*—Lathrop & Gage, LC

(57) ABSTRACT

An envelope assembly is provided for improved performance of a mailing envelope in the automated mail handling process. The envelope comprises a front panel having top, bottom and side edges and forming an envelope front surface, side flaps extending front the side edges, a rear panel extending from the bottom edge and combining with the side flaps to form an envelope rear surface, and a closure flap extending from the top edge for securing the envelope in a closed position. The rear panel is sized and configured to have a lesser width than the front panel as to expose the side flaps along the envelope rear surface. In this configuration, an automated mail opening device must only substantially cut through the side flaps and front panel to open the envelope along the side edges, as opposed to having to also cut through a substantial portion of the rear panel and an adhesive holding the rear panel and side flaps together.

19 Claims, 3 Drawing Sheets

U.S. PATENT DOCUMENTS

| | | | | |
|---|---|---|---|---|
| 4,366,636 | A | | 1/1983 | Hearsh |
| 4,436,202 | A | | 3/1984 | Berkley |
| 4,545,521 | A | | 10/1985 | Hiersteiner |
| 4,565,317 | A | | 1/1986 | Kranz |
| 4,667,457 | A | | 5/1987 | Rogovein |
| 5,168,689 | A | | 12/1992 | Macelis |
| 5,421,700 | A | | 6/1995 | Kranz |
| 5,425,565 | A | | 6/1995 | Rogovein et al. |
| 5,425,656 | A | | 6/1995 | Wakata |
| 5,464,316 | A | | 11/1995 | Kranz |
| 5,478,185 | A | | 12/1995 | Kranz |
| 5,678,754 | A | | 10/1997 | Kranz |
| 5,707,002 | A | | 1/1998 | Miyamoto |
| 5,802,808 | A | | 9/1998 | Lygia |
| 5,894,986 | A | | 4/1999 | Lederman |
| 5,927,592 | A | * | 7/1999 | Kranz ..... 229/71 |
| 5,967,403 | A | | 10/1999 | Kranz |
| 6,192,661 | B1 | | 2/2001 | Bodart |
| 6,279,817 | B1 | | 8/2001 | Flynn |
| 2005/0173500 | A1 | | 8/2005 | Kranz |

FOREIGN PATENT DOCUMENTS

| | | |
|---|---|---|
| DE | 3043192 A1 | 11/1980 |
| DE | 4436294 A1 | 4/1996 |
| DE | 29517555 U1 | 4/1997 |
| EP | 0379368 A1 | 7/1990 |
| WO | WO 8503039 | 7/1985 |

* cited by examiner

ENVELOPE HAVING IMPROVED OVERLAP PROFILE

RELATED APPLICATIONS

This application is a continuation-in-part of U.S. patent application Ser. No. 09/969,944, filed Oct. 3, 2001 now abandoned, entitled "Envelope Having Improved Overlap Profile" which is incorporated herein by reference.

BACKGROUND OF THE INVENTION

1. Field of the Invention

This invention relates generally to a mailing envelope and, more particularly, to an envelope having side seam and closure flap profiles that improve performance during processing by automated mail handing equipment.

2. Description of the Related Art

Envelopes have long been used to transport a wide variety of items through the mail, including letters, documents, photographs, and the like. In this arrangement, certain items will be placed in the generally rectangularly-shaped envelope and the closure flap subsequently adhered to securely hold the items for shipment. In recent years, there has been a need to produce a mailing envelope that is ideally suited for sending correspondence to or from businesses that deal in high-volume mailing, such as credit card companies, or other billing or advertising companies. However, because of the expense of designing specialized envelopes and various postal regulations levying surcharges for using non-standard mail, envelope designs used on a mass-market basis are very standard.

A typical mailing envelope design consists of a number of flaps and panels that are folded and adhesively secured together. Often these designs take into consideration the integrity of the envelope and the various seams which are adhered together to form its shape. Despite being structurally sound, envelopes are often difficult for automated mail handling equipment to process. Business mailings often require such equipment to perform well in all three stages of the mailing process, including: (1) insertion of an item into an envelope for shipment; (2) within the mail stream while the envelope is being transported and properly routed to its destination; and (3) automated opening of the envelope to reveal its contents. Failure at any of these stages can cause excessive delays and costs for a mass-market mailing regime that relies on such mailing handling equipment to process thousands of envelopes, and items contained therein, in a short amount of time.

During the mechanical insertion process, an envelope is advanced along a conveyor system and one or more inserts is placed inside the envelope. The envelope can then be sealed and placed into the mail stream. Various equipment is used to advance the envelope in the mail stream, including conveyor systems similar to those used in the first stage of the process. In final stage, an envelope is remitted with a check or other papers enclosed. The envelope is again received in a conveyor system and positioned such that an automated opening device can cut away the top edge and side edges of the envelope to reveal the contents. In all three stages of the mail handling process, a number of different devices are used to advance and securely hold the envelopes in position, such as mechanical fingers and other known devices.

Standard envelopes used for business mailings employ a number of design features that can cause the envelope and inserts to jam or snag within the automated mail handling equipment. For example, a typical closure flap has fairly sharp shoulder sections that frequently produce mail handling problems. Because these shoulder sections—if parallel to the envelope side edges—are aligned fairly perpendicular to the direction of travel of the envelope along the conveyor, there is little room for error by feeding or advancing equipment that grasps the closure flap of the rapidly traveling envelope. Instead of allowing the mail handling equipment to gradually encounter the closure flap, the side edge of the closure flap is substantially fully presented so that misaligned envelopes essentially cannot be aligned by the equipment.

Another feature that introduces error into the automated system is an envelope having jagged transition points between the various flaps and panels of the rear surface that make up the "throat" of the envelope. When an inserting mechanism attempts to place an insert into the envelope, the interface of the side flap with the rear panel creates a ridge that can cause the insert to snag on the throat, interfering with the proper direction of travel of the insert. Additionally, vacuum suction devices used to lift the envelope rear surface to aid in placing the insert inside the envelope may fail to properly adhere to the rear surface when encountering a jagged transition point. Further, the traditional "throat" design for an envelope present a straight edge that becomes a perpendicular barrier to inserts. Instead of allowing the insert to contact the throat gradually, the traditional design forces the insert to contact the throat all at once, often causing the insert to jam and fail to maintain proper alignment for envelope insertion.

Envelope advancement along a conveyor or similar system is also impeded by traditional envelope configurations. For ease of manufacture, the side seam formed at the junction of the envelope rear and side panels are typically positioned immediately adjacent to the overall envelope side edge. However, this design can cause various envelope-grabbing apparatuses (e.g., mechanical fingers) to snag or catch on the seam as the envelope side edge is grasped for advancement. Under these circumstances, the integrity of the envelope is compromised. Further, such a design often forces an automated opening device to cut through an adhesive layer holding the rear panel and side flaps together, speeding the dulling and degradation of the opening device.

One type of envelope design that avoids some of the aforementioned problems is a diagonal cut envelope. This envelope design includes a pair of diagonal seams extending upwardly and inwardly from both lowermost corners of the rear panel of the envelope. Although this envelope addresses the concern with automated mail handling equipment, these envelopes present an uneven rear panel surface. This is undesirable because it is often necessary, especially in bulk mailings, to include printing or a window on the rear panel surface of the envelope. An uneven surface greatly complicates the application of printing or the inclusion of a window.

Thus, a need exists for a new envelope design having a panel and flap arrangement that minimizes problems at all stages of the automated mail handling process and presents a smooth rear panel surface. This design would provide the same overall outside dimensions as a standard business mailing envelope while being configured for ease of manufacture.

SUMMARY OF THE INVENTION

It is an object of the present invention to provide an envelope assembly having an improved panel and flap geometry. It is a further object of the present invention to provide such an envelope that is configured for ease of accurate placement of an insert within the envelope pocket. It is yet a further object of the invention to provide such an envelope configured for smooth feeding and advancement within automated mail handing equipment. It is still a further object of the present invention to provide such an envelope with a panel and flap configuration such that an envelope opening device must penetrate a minimum amount of material, and essentially no adhesive, in order to cut open the envelope. It is yet another object of the present invention to provide such an envelope with the panel and flaps adhered together such that an envelope insert will not be caught between any envelope seams. It is still further an object of the present invention to provide such an envelope that is durable, easy to manufacture, inexpensive to produce and generally well suited for the intended usage thereof.

The present invention provides an envelope assembly, or envelope, with an improved panel and flap configuration for better performance in the automated mail handling process. The envelope comprises a front panel having top, bottom and side edges, side flaps extending from the side edges, a rear panel extending from the bottom edge, and a closure flap extending from the top edge. The front panel has a typical rectangular shape and forms the front surface of the envelope. The envelope rear surface is formed by folding over the rear panel and side flaps along the front panel bottom and side edges, respectively, to overlap each other and be positioned opposite of the front panel. An adhesive is used to secure the rear panel and side flaps together to create the envelope pocket into which items to be mailed are placed. To seal the envelope pocket, the closure flap is folded over from the front panel top edge towards the rear surface and an adhesive secures the closure flap to the rear surface in an overlapping relationship.

The improved performance of the envelope is achieved through altering the standard configuration and dimensions of the aforesaid envelope components. Each of a set of side edges of the rear panel have a tapering region sloping inward from the envelope side edges and extending upward from the envelope bottom corners. Thus, a substantial portion of the rear panel has a shorter width from side edge to side edge than the front panel. This configuration tapers the rear surface side seams away from the envelope side edges and exposes a much larger area of the side flaps along the envelope rear surface, thereby providing two key benefits. First, the tapered side seams allow a mail handling system to more easily grasp the side flaps for better envelope advancement. Secondly, the exposed side flaps facilitate an automated opening device cutting through merely the side flaps and front panel to open the sides of the envelope to remove the contents, as opposed to cutting additionally through the rear panel and the adhesive securing the side flaps to the rear panel. In addition, the rear panel is adhered to side flaps as close to the inside edge of the flaps as possible such that any items placed in the envelope will not become wedged between the rear panel and the side flaps, which would make it more difficult for automated mail handling equipment to extract the items.

To facilitate placement of an insert within the envelope pocket, the rear panel and side flaps have sloped upper edges extending downward from the envelope upper corners toward the center of the rear surface. In this configuration, the upper edges of the rear panel and side flaps form a "V-throat" that allows gradual contact of an insert with the envelope to reduce jamming or improper insert alignment. Further, the rear panel and side flaps have an optimized geometry to provide a relatively smooth transition point along the recited upper edges that form the "V-throat" such that inserts are unlikely to snag when contacting the envelope at insertion.

The closure flap is provided with generally curved shoulder areas extending along an outer edge of the closure flap proximal to the envelope upper corners. The advantage provided by such a shoulder area design is that envelope feeding and advancing devices in the mail handling process that first encounter the side edge of an envelope will receive the closure flap more gradually. This allows such devices to adjust more easily to the position of the closure flap as it is advancing and thereby reduce jamming of the envelope. Beyond the shoulder area region, the side flap upper edge is sufficiently sized and shaped as to provide sufficient coverage of the "V-throat" region of the envelope rear surface when the envelope is sealed.

In view of the foregoing discussion, it can be seen that the present invention solves many of the problems associated with the use of standard business mailing envelopes in the automated mail handling process.

Other advantages and components of the present invention will become apparent from the following description taken in conjunction with the accompanying drawings, which constitute a part of this specification and wherein are set forth exemplary embodiments of the present invention to illustrate various objects and features thereof.

DETAILED DESCRIPTION OF THE INVENTION

Figure 1:
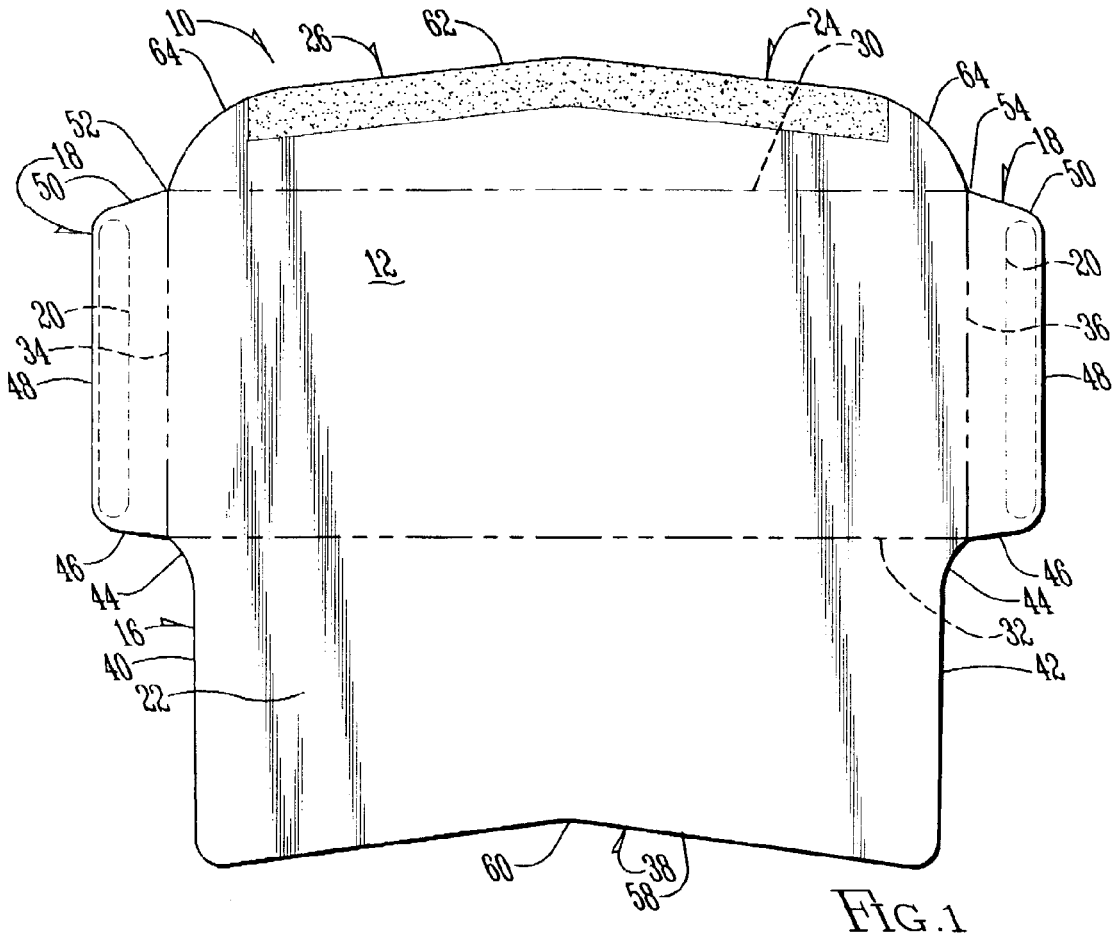
FIG. 1 is a front elevational view showing an embodiment of the envelope assembly of the present invention in which the envelope is in a non-folded configuration prior to final assembly.

An envelope assembly in accordance with the present invention is shown generally at 10 in FIG. 1. The envelope comprises a front panel 12, a rear panel 16, a pair of side flaps 18 combining with the rear panel 16 when folded to form a rear surface 22 generally parallel to the front panel 12, and a closure flap 24 for securing the envelope in a closed position.

Figure 2:
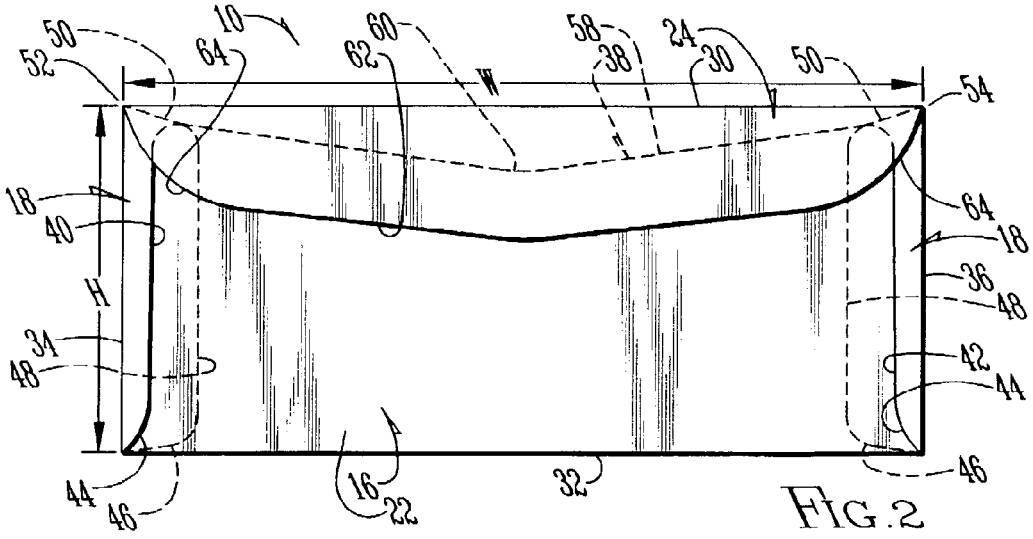
FIG. 2 is a rear elevational view showing the folded envelope and closure flap in a closed position.

The envelope 10 is typically manufactured from a single piece of flat material, such as paper stock or plastic, that is cut along an outer edge 26 to create the geometry of the various components that form the envelope. A number of lines of weakness are formed to facilitate folding along such lines to position the envelope components for final assembly, as is well known in the art. Adhesive 20 (or other joining means) is then used to securely hold the rear panel 16 and side flaps 18 together to create the rear surface 22, as seen in FIG. 2.

Figure 3:
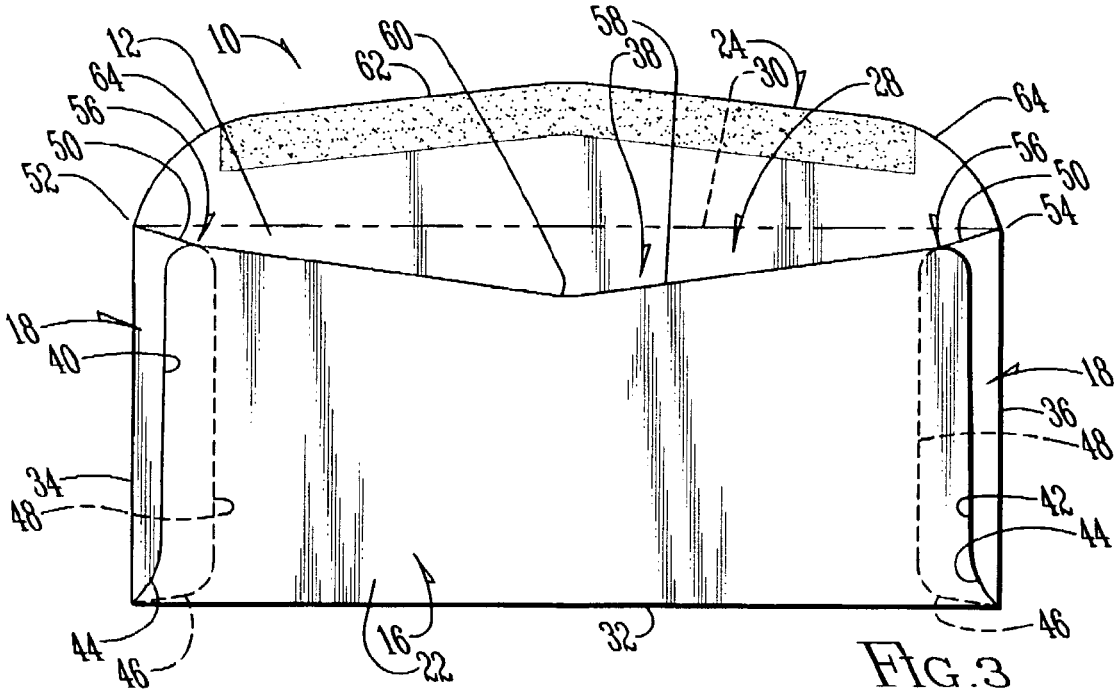
FIG. 3 is a rear elevational view showing the folded envelope and closure flap in an open position.

The folded envelope 10 defines an envelope pocket 28 bounded by the front panel 12 and rear surface 22, an envelope top edge 30, bottom edge 32, and side edges 34, 36, as best seen in FIG. 3. The distance from the envelope top edge 30 to the bottom edge 32 defines an envelope height (H), frequently 4⅛ inches. Likewise, the distance from one envelope side edge 34 to another envelope side edge 36 defines an envelope width (W), frequently 9½ inches. Although the envelope 10 is optimally designed for mailing inserts to or from a business interest that utilizes automatic mail handling equipment, it shall be obvious to those skilled in the art that the envelope can be used for mailing other items, or for non-mailing usages such as storing documents.

The front panel 12 is generally rectangular in shape. If desired, the front panel 12 may include an aperture (not shown) formed into the surface to create a window in which an address placed on the envelope contents can be viewed, as is well known in the art. This window may have a protective transparent coating. The front panel 12 is interconnected with the rear panel 16 along the envelope bottom edge 32 and is formed with the pair of side flaps 18 and the closure flap 24. As best seen in FIG. 3, the rear panel 16 has a top edge 38 and a pair of analogous side edges 40, 42. Although the rear panel 16 generally forms a substantial portion of the rear surface 22, it is somewhat smaller in overall dimensions than the front panel 12. The rear panel 16 shares a common envelope bottom edge 30 with the front panel 12, at which point both panels have a width that is the same as the envelope width (W).

Proceeding upward along the side edges 40, 42, a generally curved inwardly tapering region 44 is formed where the overall width of the rear panel 16 between the side edges is less than that of the envelope width (W). The rear panel side edges 40, 42 slope inward and away from the envelope side edges 34, 36 in the tapering region 44. Preferably, the inward slope of side edges 40, 42 is a rapid taper beginning with a slope of at least 30 degrees, and ideally at least 40 degrees, away from envelope side edges 34, 36 immediately adjacent to bottom edge 32. This inward slope becomes less dramatic moving up the side edges 40, 42 in the tapering region 44. Above the tapering region, rear panel side edges 40, 42 are preferably straight edges that may be parallel to the envelope side edges 34, 36 for a distance, or may slightly taper away from the side edges 34, 36 moving up edges 40, 42 to expose a greater width of the side flaps 18. Preferably the exposed width of each of the side flaps 18 above the tapering region 44 is at least 3⁄16 of an inch for an envelope with a width of about 9½ inches. It is preferred that this exposed width of each of the side flaps 18 above the tapering region 44 is at least 3⁄16 of an inch and less than 1 inch for at least sixty percent (and ideally at least 3⁄16 of an inch and less than ½ inch for at least seventy-five percent) of the height of the respective side edge 40, 42 of the rear panel 16. In this configuration, the rear panel 16 has a width that is less than the front panel 12 to facilitate an automated opening device having to substantially only cut through the side flaps 18 and the front panel 12 to open the envelope side edges 34, 36. As a consequence, the automated opening device does not have to cut through, at most more than a small section of the rear panel 16 near the tapering region 44, nor must the device cut through adhesive 20 holding the rear panel 16 and the side flaps 18 together. One exemplary automated opening device that may be used includes a cutting mechanism with a rotary blade, such as taught in U.S. Pat. No. 5,946,996, issued to Oussani, Jr. et at., the teachings of which are incorporated herein by reference.

Figure 4:
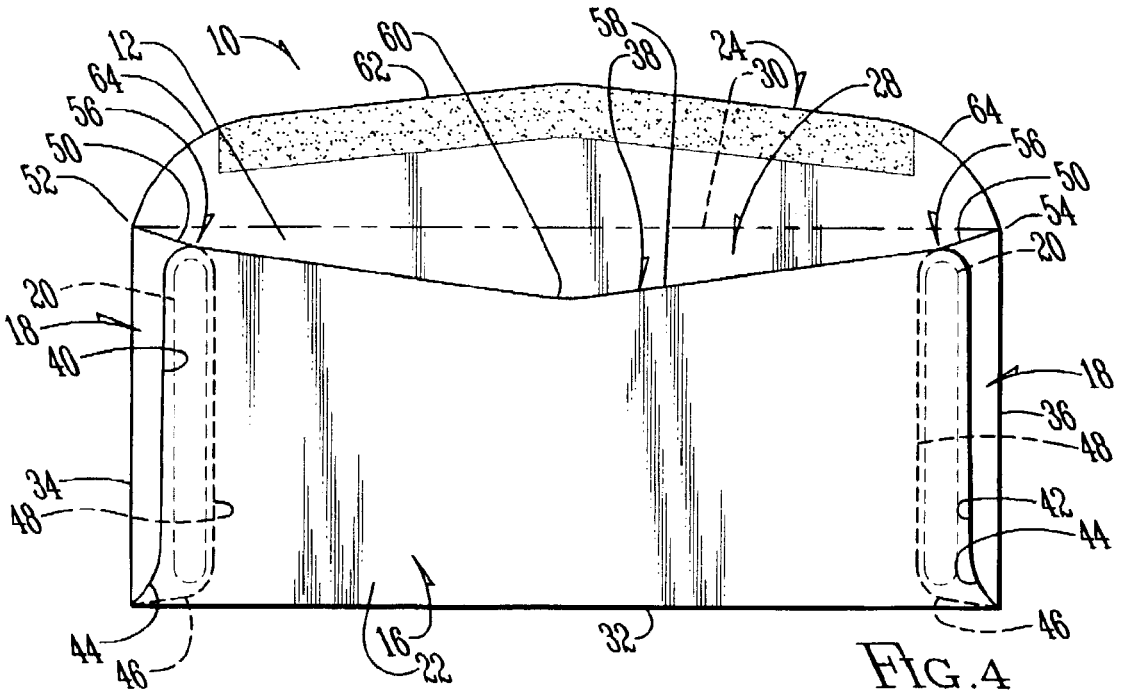
FIG. 4 is a rear elevational view showing the location of the adhesive sections holding the rear panel and side flaps together.

The side flaps 18 are generally identical in configuration and extend between a portion of the front panel 12 and rear panel 16 for the folded envelope. Each of the side flaps 18 comprises a generally trapezoidal shaped flap having a bottom edge 46, an inside edge 48, and a top edge 50. It is to be understood, however, that the side flaps 18 can be of any shape known in the art for securing the position of the rear panel 16, such as rectangular, half-circle, or other shapes. The bottom edge 46 extends generally inward from the envelope side edges 34, 36 and upward from the envelope bottom edge 30. Although the exact geometry of the bottom edge 46 is not critical, it must extend sufficiently inwardly from the envelope side edges 34, 36 as to extend beyond the corresponding rear panel side edges 40, 42 and create an overlapping profile with the rear panel 16, Preferably, the rear panel 16 overlaps a portion of each side flap 18 and the adhesive 20 is placed on a rearwardly facing surface of each side flap 18 to adhere the side flap 18 to the rear panel 16, as shown in FIG. 4. Alternatively, each side flap 18 may overlap a portion of the rear panel 16 and the adhesive 20 is provided on a forwardly facing surface of each side flap 18 to adhere the side flap 18 to the rear panel 16.

Preferably, each side flap has a width of approximately ⅞ inch for an envelope width of about 9½ inches. Additionally, it is preferred that the side flaps 18 are adhered with adhesive 20 to the rear panel 16 at least immediately adjacent to the inside edge 48, as shown in FIG. 4, such that an insert placed in the envelope pocket 28 will not snag or get caught between the side flaps 18 and the rear panel 16. The inside edge 48 gradually transitions into the top edge 50 extending to upper corners 52, 54 of the envelope formed at the junction of the envelope top edge 30 with the envelope side edges 34, 36. Preferably, the top edge 50 slopes downward from the upper corners 52, 54.

Figure 5:
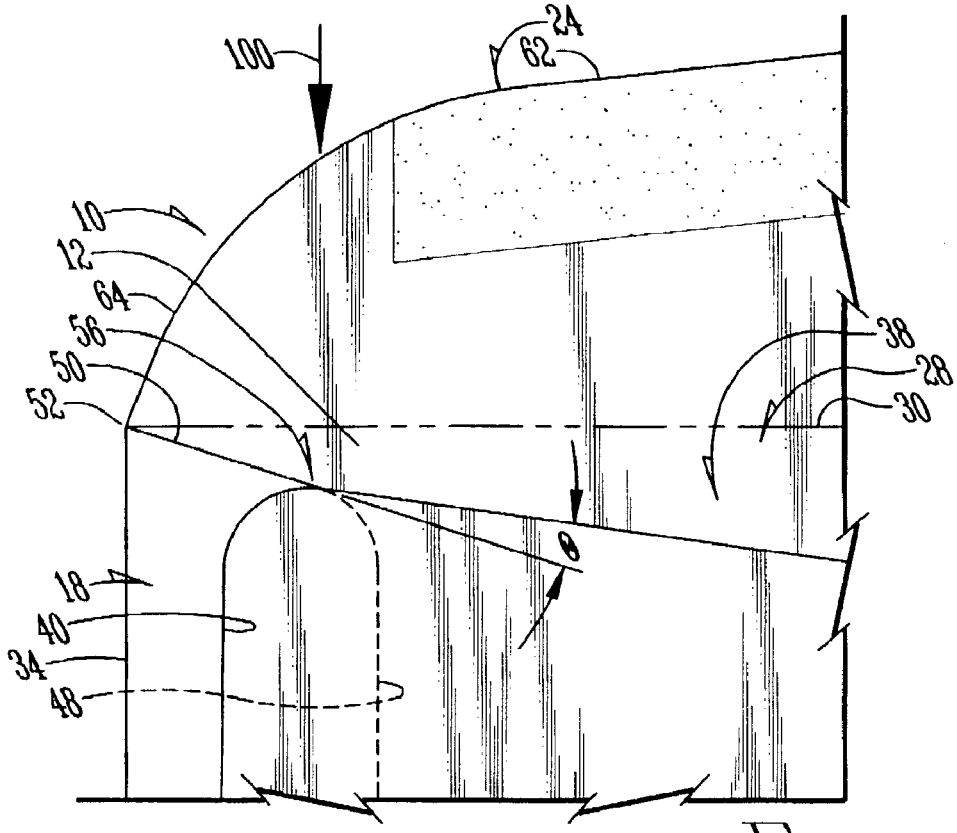
FIG. 5 is a close-up view of the envelope of FIG. 4 showing the transition point between one of the side flaps and the rear panel.

At the junction of the side flap top edges 50 and the rear panel top edge 38 are relatively smooth transition points 56, shown in a close-up view in FIG. 5. Transition points 56 facilitate the smooth and accurate placement of the envelope insert into the envelope pocket 28 by automated mail handling equipment. Additionally, this configuration allows the side flaps 18 and rear panel 16 to be adhered (i.e., with adhesive 20) near both the side flap top edges 50 and the rear panel top edge 38 to prevent inserts from catching in between the side flaps 18 and rear panel 16 near the transition point 56. To achieve the benefits of the relatively smooth transition points 56, the inside angle B (also referred to as the "transition angle") formed between a tangent line to the rear panel top edge 38 at each of the transition points 56 and a tangent line to the respective side flap top edge 50 at the respective transition point 56 should be about 15 degrees or less, and preferably about 10 degrees or less. At these angles, inserts that contact transition points 56 when moved downward into envelope pocket 28 in the direction of insertion arrow 100 will tend to slide past transition points 56, such that the points 56 do not significantly impede the motion of the insert into the pocket 28.

Continuing inward from the transition point 56, the rear panel top edge 38 preferably has a downward slope such that the top edge 38, along with side flap top edges 50, form a V-shaped envelope throat 58 with a lowermost portion 60 located approximately midway between the rear panel side edges 40, 42. In this configuration, the lowermost portion is preferably located about 11⁄16 of an inch below the envelope top edge 30 for an envelope having a height of about 4⅛ inches. As with the transitions point 56, the envelope throat 58 geometry aids in accurate placement of the insert within the envelope pocket 28 because inserts traveling downward into the envelope pocket 28 will contact the throat 58 gradually, allowing the insert to more easily readjust if not perfectly aligned with the pocket.

The closure or seal flap 24 extends from the front panel 12 along the envelope top edge 30 and is movable between an open position where items can be inserted and removed from the envelope pocket 28, and a closed or sealed position where the flap overlaps and adheres to the envelope rear surface 22. The closure flap 24 has an outer edge 62 that can have a range of profiles as long as the flap has sufficient height as to overlap with the envelope throat 58 and adhere to the rear surface 22. In the preferred embodiment, the closure flap 24 has a pair of curved shoulder regions 64 extending from each of the envelope upper corners 52, 54 along the outer edge 62. Preferably, the radius of curvature of the shoulder regions 64 is at least 1 inch, and preferably about 1⅝ inches, and the length of the shoulder regions along the closure flap outer edge 62 is at least 1 inch, and preferably about 1¾ inches, for an envelope having a width of about 9½ inches and a height of about 4⅛ inches. Additionally, the peak height of the closure flap 24 should be about 1⅝ inches to adequately cover the V-shaped envelope throat 58 of an assembled envelope having a width of about 9½ inches and a height of about 4⅛ inches. The shoulder regions 64 ensure that envelope feeding and advancing devices in the automated mail handling process that first encounter the side edge of an envelope receive the closure flap gradually. This allows the mail handling devices to adjust to the position of the closure flap 24 as it is advancing and thereby reduce the likelihood of the envelope 10 jamming. This closure flap profile further cooperates with the closure flap opening mechanism of an inserting machine to reduce jamming of the closure flap.

Figure 6:
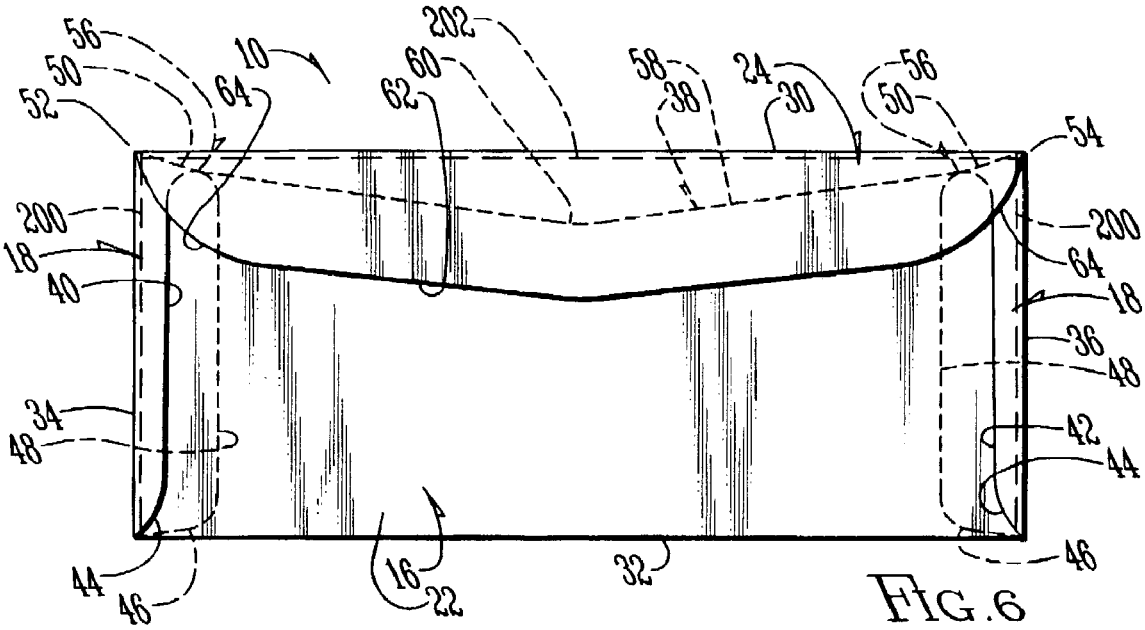
FIG. 6 is a rear elevational view of the envelope of FIG. 2 showing a top cut line and side cut lines.

In the automated mail handing process, mail handing equipment receives an envelope 10 containing an insert for processing. More specifically, an automated opening device secures the position of the envelope 10 and makes a series of side cuts 200 adjacent to one or more of the envelope side edges 34, 36, and, if desired, a top cut 202 adjacent to the envelope top edge 30, as shown in FIG. 6. Because of the significant tapering of the rear panel side edges 40, 42 and corresponding exposure of the side flaps 18 along the envelope rear surface 22, the cutting mechanism of the automated opening device—at least the portion of the cutting mechanism forming the side cuts 200—need only penetrate the side flaps 18 and the front panel 12 for a significant distance along the envelope side edges 40, 42 to open the envelope ends. Consequently, the portion of the cutting mechanism forming the side cuts 200 merely penetrates, at most, a small section of the rear panel 16, a small section of closure flap 24, and none of the adhesive 20 that holds the rear panel and side flaps 18 together. If desired, the side cuts 200 can be made on the exposed side flaps 18 only between the rear panel 16 at a lower edge of the cut and the closure flap 24 at an upper edge of the cut, so that neither the rear panel 16 or closure flap 24 are cut at all, if the envelope insert is sufficiently small as can be retrieved through a side cut 200 of this dimension. These side cut 200 configurations significantly decrease the wear and stress placed on the cutting mechanism from substantially cutting through more than two material layers and/or adhesive. If the side cuts 200 and top cut 202 are performed, the mail handling equipment can separate the front panel 12 and rear surface 22 and remove the insert contained therein for processing.

Thus, the folded envelope of the present invention provides an improved design that offers more reliable performance in the automated mail handing process. This design incorporates a panel and flap configuration that facilitates the placement of inserts within the envelope, the movement of the envelope through the mail handing process, and the opening of the envelope by automated opening devices. While certain forms of the present invention have been illustrated and described herein, it is not to be limited to the specific forms or arrangement of parts described and shown.

What is claimed is:

1. An envelope comprising:

a front panel having a generally rectangular shape and forming an envelope front surface, the front panel defining opposite first and second side edges of the envelope;

a rear panel interconnected with the front panel along a common bottom edge, the rear panel having a top edge and first and second side edges, the first and second side edges having a rapidly tapering region defining an area of panel width proximal to the bottom edge that is reduced from the panel width along the bottom edge, a portion of the rear panel first and second side edges above the rapidly tapering region extending substantially parallel to the respective first and second side edges of the envelope;

first and second side flaps interconnected with the front panel along common opposite side edges, the side flaps being fixedly joined to the rear panel to form an envelope rear surface positioned opposite of the envelope front surface; and a closure flap interconnected with the front panel along a common top edge and having an outer edge forming a set of shoulder areas proximal to the top edge; and wherein the rear panel is fixedly joined to the first and second side flaps at least proximal to an inside edge of the side flaps, the side flaps being exposed along the envelope rear surface as to define a first overlap transverse dimension from the rear panel first side edge to the first side flap side edge and a second overlap transverse dimension from the rear panel second side edge to the second side flap side edge, both the first and second overlap transverse dimensions comprising a width greater than 3/16 of an inch for at least sixty percent of the longitudinal dimension from the rear panel bottom edge to the rear panel top edge.

2. The envelope of claim 1, wherein the rapidly tapering region forms an angle between the first and second side edges of the envelope and the respective side edges of the rear panel greater than about 30 degrees at a lower point of each of the rear panel side edges.

3. The envelope of claim 2, wherein the angle formed between the first and second side edges of the envelope and the respective side edges of the rear panel is greater than about 40 degrees at a lower point of each of the rear panel side edges.

4. The envelope of claim 1, wherein the rear panel side edges in the rapidly tapering region are curved.

5. The envelope of claim 1, wherein the portion of the rear panel first and second side edges above the rapidly tapering region extending substantially parallel extends at an angle of less than about 10 degrees with respect to first and second side edges of the envelope.

6. The envelope of claim 1, wherein the shoulder areas extend for at least one inch along the closure flap outer edge and having a radius of curvature of at least one inch.

7. An envelope having a top edge, a bottom edge and first and second side edges, the envelope comprising:

a front panel;

a rear panel interconnected with the front panel along a common bottom edge, the rear panel having a top edge and first and second side edges, the first and second side edges having a rapidly tapering region defining an area of panel width proximal to the bottom edge that is reduced from the panel width along the bottom edge, a portion of the rear panel first and second side edges above the rapidly tapering region extending substantially parallel to the respective first and second side edges of the envelope;

first and second side flaps interconnected with the front panel along a line of weakness to define opposite side edges for the envelope as the first and second side flaps are folded toward the rear panel, the first and second side flaps extending inwardly a sufficient span as folded from the line of weakness to extend beyond the first and second side edges of the rear panel, the first and second side flaps being secured to the rear panel to cooperatively form an envelope rear surface positioned opposite of the front panel;

a closure flap interconnected with the front panel along a common top edge and having an outer edge forming a set of shoulder areas proximal to the top edge; and at least one side cutting region bounded by one of the first and second side edges of the envelope and a respective edge of the first and second side edges of the rear panel, the at least one side cutting region consisting of a portion of the front panel and one of said first and second side flaps, the at least one side cutting region sized and configured for cutting therethrough by an automated envelope cutting device, the at least one side cutting region extending inwardly from one of the first and second side edges of the envelope for greater than 3/16 of an inch for at least sixty percent of the height of the respective side edge of the rear panel.

8. The envelope of claim 7, wherein a first transition point is formed at an intersection of the first side flap and the rear panel top edge and a second transition point is formed at an intersection of the second side flap and the rear panel top edge, each of the first and second transition paints having a transition angle defined between a tangent line to the rear panel top edge at the respective transition point and a tangent line to the respective side flap at the respective transition point, the transition angles being about 15 degrees or less.

9. The envelope of claim 7, wherein the transition angle of each of the first and second transition points is about 10 degrees or less.

10. The envelope of claim 7, wherein the rapidly tapering region forms an angle between the first and second side edges of the envelope and the respective side edges of the rear panel greater than about 30 degrees at a lower point of each of the rear panel side edges.

11. The envelope of claim 8, wherein the portion of the rear panel first and second side edges above the rapidly tapering region extending substantially parallel extends at an angle of less than about 10 degrees with respect to the first and second side edges of the envelope.

12. The envelope of claim 8, wherein the rear panel top edge forms a throat region sloping downward from first and second peaks proximal to the first and second transition points.

13. An envelope having a top edge, a bottom edge and first and second side edges, the envelope comprising:

a front panel;

a rear panel interconnected with the front panel along the bottom edge of the envelope, the rear panel having a top edge and first and second side edges, at least a portion of the rear panel between the first and second side edges having a width that is reduced from the panel width of the rear panel along the bottom edge;

first and second side flaps interconnected with the front panel along a line of weakness to define opposite first and second side edges for the envelope as the first and second side flaps are folded toward the rear panel, the first and second side flaps extending inwardly a sufficient span as folded from the line of weakness to extend beyond the first and second side edges of the rear panel, the first and second side flaps being secured to the rear panel to cooperatively form an envelope rear surface positioned opposite of the front panel;

a closure flap interconnected with the front panel along a common top edge; and at least one side cutting region bounded by one of the first and second side edges of the envelope and a respective edge of the first and second side edges of the rear panel, the at least one side cutting region consisting only of a portion of the front panel and one of said first and second side flaps, the at least one side cutting region sized and configured for cutting therethrough by an automated envelope cutting device, the at least one side cutting region extending inwardly from one of the first and second side edges of the envelope for greater than 3/16 of an inch and less than 1 inch for at least sixty percent of the height of the respective side edge of the rear panel;

wherein a first transition point is formed at an intersection of the first side flap and the rear panel top edge and a second transition point is formed at an intersection of the second side flap and the rear panel top edge, each of the first and second transition points having a transition angle defined between a tangent line to the rear panel top edge at the respective transition point and a tangent line to the respective side flap at the respective transition point, the transition angles being about 15 degrees or less.

14. The envelope of claim 1, wherein the transition angle of each of the first and second transition points is about 10 degrees or less.

15. The envelope of claim 13, wherein the transition angle of each of the first and second transition points is about 10 degrees of less.

16. The envelope of claim 6, wherein:

the transition angle of each of the first and second transition points is about 10 degrees or less; and the at least one side cutting region extends inwardly from one of the first and second side edges of the envelope for greater than 3/16 of an inch and less than 1/2 inch for at least seventy-five percent of the height of the respective side edge of the rear panel.

17. The envelope of claim 13, wherein the closure flap has an outer edge forming a set of shoulder areas proximal to the top edge, the shoulder areas having a rounded contour extending for at least 1 inch along the outer edge.

18. The envelope of claim 5, wherein the radius of curvature of the shoulder areas is at least 1 inch.

19. The envelope of claim 13, wherein the rear panel top edge forms a throat region sloping downward from the first and second transition points.

* * * * *